US007143714B1

(12) United States Patent
Schmidt

(10) Patent No.: US 7,143,714 B1
(45) Date of Patent: Dec. 5, 2006

(54) WATER CRAFT INFLATABLE FENDER SYSTEM

(75) Inventor: Steven Schmidt, Picton (NZ)

(73) Assignee: NAIAD Design Limited, Picton (NZ)

( * ) Notice: Subject to any disclaimer, the term of this patent is extended or adjusted under 35 U.S.C. 154(b) by 0 days.

(21) Appl. No.: 10/110,425

(22) PCT Filed: Oct. 11, 2000

(86) PCT No.: PCT/NZ00/00196

§ 371 (c)(1),
(2), (4) Date: Apr. 11, 2002

(87) PCT Pub. No.: WO01/26959

PCT Pub. Date: Apr. 19, 2001

(30) Foreign Application Priority Data

Oct. 11, 1999 (NZ) ..... 337614

(51) Int. Cl.
*B63B 7/00* (2006.01)

(52) U.S. Cl. ..... 114/345

(58) Field of Classification Search ..... 114/218, 114/219, 123, 345

See application file for complete search history.

(56) References Cited

U.S. PATENT DOCUMENTS

| | | | | |
|---|---|---|---|---|
| 1,828,801 | A * | 10/1931 | Finlayson | |
| 4,526,122 | A * | 7/1985 | Kluckhuhn | 114/106 |
| 4,724,792 | A * | 2/1988 | Cochran | 114/345 |
| 4,928,619 | A * | 5/1990 | Cochran | 114/345 |
| 6,371,040 | B1 * | 4/2002 | Hemphill et al. | 114/219 |

* cited by examiner

*Primary Examiner*—Ed Swinehart
(74) *Attorney, Agent, or Firm*—D. Peter Hochberg; Sean Mellino

(57) ABSTRACT

A water craft fender system which utilises an inflatable bladder (1) having an outer cover (10) which has edges shaped (11) to enclose a bolt rope (12). The edges (11) with the bolt rope (12) are inserted into grooves (8) of bolt rope holders 6/7 which extend around the hull of the water craft. The ends of the bolt rope (12) are secured to a bolt rope locking device which is formed of two parts (15 and 16), one of which is adapted to be attached to the hull of the water craft and the second part engages with the first part to grip the ends of the bolt rope (12).

10 Claims, 4 Drawing Sheets

WATER CRAFT INFLATABLE FENDER SYSTEM

BACKGROUND TO THE INVENTION

This invention relates to watercraft and in particular but not necessarily to inflatable watercraft. It is desirable that such watercraft include a form of fender to protect the sides of the water craft from damage through contact with other objects. In addition it is desirable that the fender be buoyant to assist in the buoyancy of the craft should that be necessary.

PRIOR ART

U.S. Pat. No. 5,584,260 discloses a device which enables an inflatable tube to be joined to the hull and deck of a water craft. The device has a deck flange and a hull flange. The deck flange has a trough which includes a connector element whereby an inflatable tube can be attached to the flange.

U.S. Pat. No. 4,628,854 discloses another method of attaching an inflatable buoyancy tube to a hull of a water craft. The tube is clamped in position on the edge of the hull by using clamping strips.

U.S. Pat. No. 4,934,301 discloses another method of securing a tube to the hull of an inflatable water craft. A plate is attached to the outside of the tube and a bolt passes through the plate and through a flange projecting from the hull of the water craft to secure the tube to the water craft.

U.S. Pat. No. 4,976,213 discloses another method of securing a tube to an inflatable water craft by using a toggle stop which is attached to the tube and which passes through a hole formed in the hull or other anchorage portion to secure the tube to the hull. It is stated that inflation of the tube will tension the toggle to assist the attachment of the tube to the hull.

U.S. Patent Specification discloses an inflatable water craft which has multiple inflatable bladders which define a ring at or above the water line of the hull. A hole is formed in the hull so a holding structure which can be part of the tube will engage in the hole to retain the bladder on the hull when the bladder is inflated.

U.S. Pat. No. 3,688,728 discloses a bumper assembly for a water craft. The assembly includes a continuous track position immediately below the flare of the gunwale of the water craft and extending from the forward end of the water craft to the transom. Sliding blocks are positioned in the track and can be locked in the desired position by a lever means. The bumper is attached to the hull by ropes connected to two adjacent levers.

U.S. Pat. No. 4,919,067 discloses a water craft which has rigid pontoons which form the perimeter structure. The rigid pontoons will protect interior inflatable pontoons.

U.S. Pat. No. 4,817,555 discloses a water craft flotation collar which consists of a generally "U" shaped bumper guard which houses an inflatable bag or bags which can be automatically inflated to prevent the water craft from sinking.

U.S. Pat. No. 4,867,094 discloses a construction of a water craft which has an external longitudinal recess which houses a folded inflatable bag. A cover which is fitted over the recess will be blown clear when the bag is inflated to provide buoyancy.

It is apparent that while it is well known to surround part or all of the hull of a water craft with bumpers or inflatable tubes, nevertheless the known methods have considerable disadvantages. None of the prior structures are capable of being quickly and easily removed or re-installed or of being able to be simply changed or used in different configurations for particular circumstances.

OBJECT OF THE INVENTION

It is therefore an object of this invention to provide an improved structure whereby an inflatable fender can be readily attached to or detached from the perimeter of the hull of a water craft.

DISCLOSURE OF THE INVENTION

Accordingly one form of the invention may be said to comprise a water craft fender system including:

an inflatable bladder adapted to be removably secured to the hull of the water craft, bolt rope holders adapted to be secured to the water craft to define a perimeter on the exterior of the hull of the water craft, an outer covering to the bladder, said covering having edges adapted to surround a bolt rope, and a bolt rope locking device adapted to secure the ends of the bolt rope to the exterior of the hull of the water craft, wherein the bolt rope holders are adapted to receive and capture the edges of the outer covering and to retain the bladder and outer covering on the hull of the water craft.

Preferably the bolt rope holders are spaced apart and each have an outwardly facing longitudinal groove and a longitudinal throat forming an entrance to the groove said throat having walls which are spaced apart a dimension less than the diameter of the goove.

Preferably the bolt rope holders are attached in a spaced apart manner to an inwale to be secured to the hull of the water craft.

Preferably the bolt rope locking device comprises two separable parts, which when assembled form a groove to receive and retain the ends of the bolt rope to secure the fender system to the exterior of the hull of the water craft.

Preferably the bladder includes a valve by which the bladder may be inflated and deflated, and wherein at least one valve is attachable to the hull of the water craft.

Preferably the outer covering is removable from the inflatable bladder.

Preferably an intermediate layer is sandwiched between the bladder and the outer covering.

Preferably wherein the intermediate layer is composed of foam.

Preferably the intermediate layer is a strengthening layer.

BRIEF DESCRIPTION OF THE DRAWINGS

Preferred forms of the fender system will now be described with the aid of the accompanying drawings in which.

FIG. I is a diagrammatic sectional view of one form of the fender system of the present invention attached to the hull of a water craft.

DETAILED DESCRIPTION OF THE PREFERRED EMBODIMENTS

Figure 1:
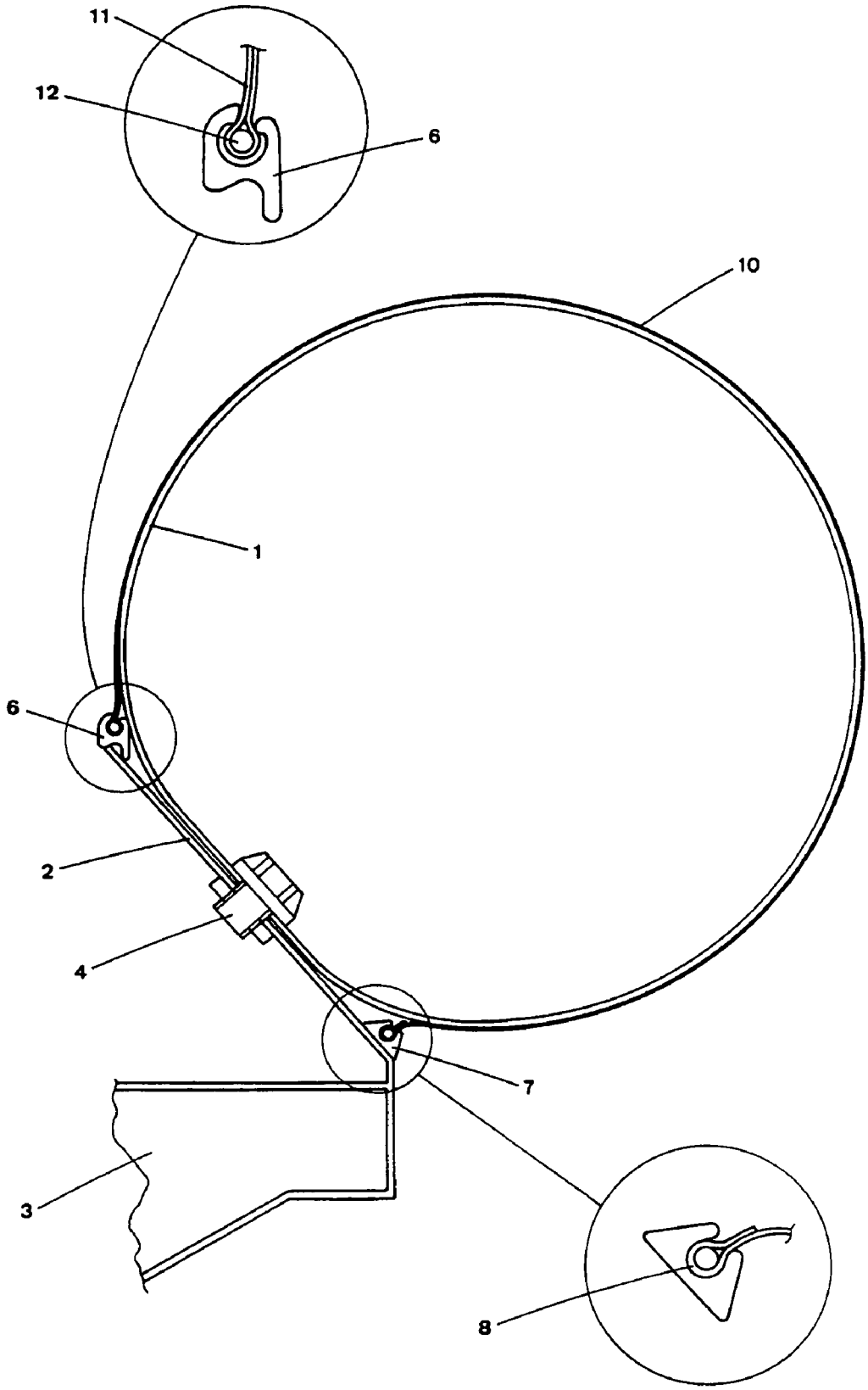

The fender system as illustrated preferably includes an inflatable inner bladder 1 which is formed of an elastomeric substance such as butanol. The inner bladder is attached to an inwale 2 on an extension of the deck 3 of the water craft by a valve 4 which serves the dual purpose of enabling the bladder to be inflated and deflated and also retains the bladder on the inwale 2. It will be understood that multiple valves 4 can be utilised together with other forms of attachment members (not shown in the drawings) as necessary to enable adequate anchorage of the bladder to the inwale 2.

Upper and lower bolt rope holders 6 and 7 (see particularly FIG. 1) are attached to the inwale 2 in a spaced apart manner as illustrated. Each bolt rope holder comprises an extrusion of a plastic material or of an extrudable material such as aluminum which has a surface by which the bolt rope holder can be permanently attached to the inwale 2. The holders 6 and 7 also include an outwardly facing groove or channel 8 which as illustrated is essentially circular adjacent the root of the groove. An entrance to the groove comprises a throat 9 which is of a lesser dimension than the diameter of the groove or channel 8. In a highly preferred form, the bolt rope holders 6 and 7 extend around the hull of the water craft and terminate adjacent the bow.

The fender system includes the bladder 1 and also one or more outer coverings. As illustrated in FIG. 1, the outer covering 10 may comprise a length of a tough, wear resistant woven or non woven fabric having edges 11 which are attached to the holders 6 and 7 by having the edges 11 folded over as illustrated to house a rope 12. The finished diameter of the folded over ends 11 and the rope is such that although the edges of the outer covering can slide in the groove, because of the restricted size of the throat, (see particularly the enlarged illustrations in FIG. 1), the edges of the covering cannot be pulled out of the groove.

Figure 2:
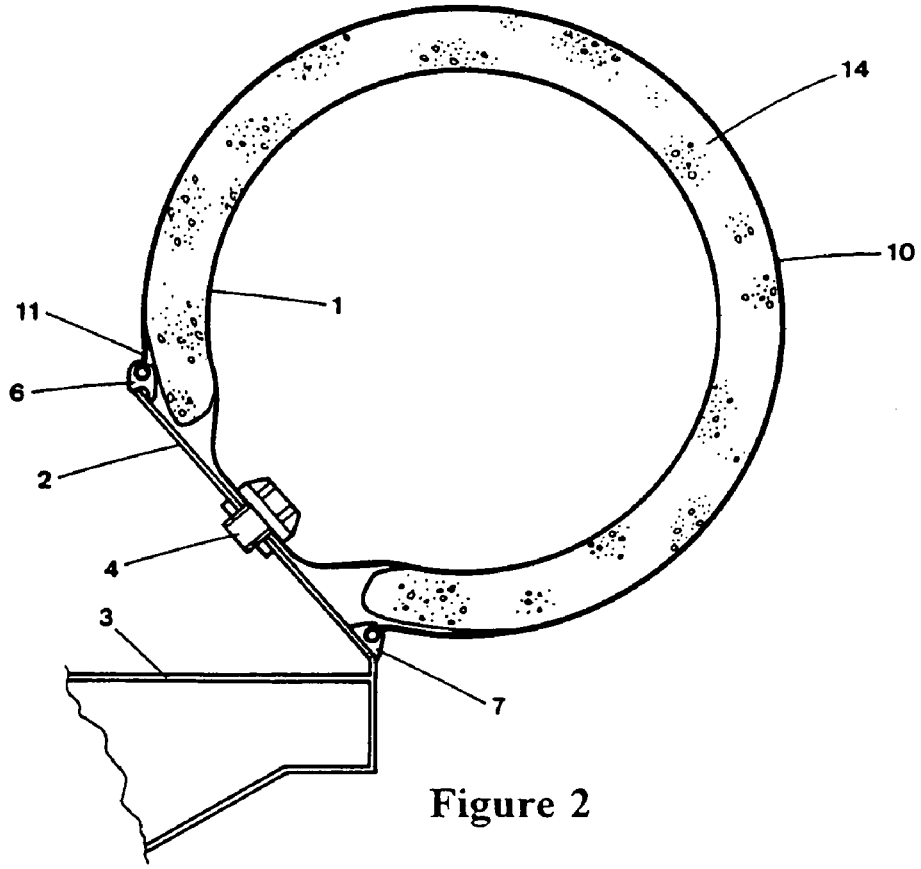
FIG. 2 is a view similar to FIG. I but illustrating another form of the fender system.
Figure 3:
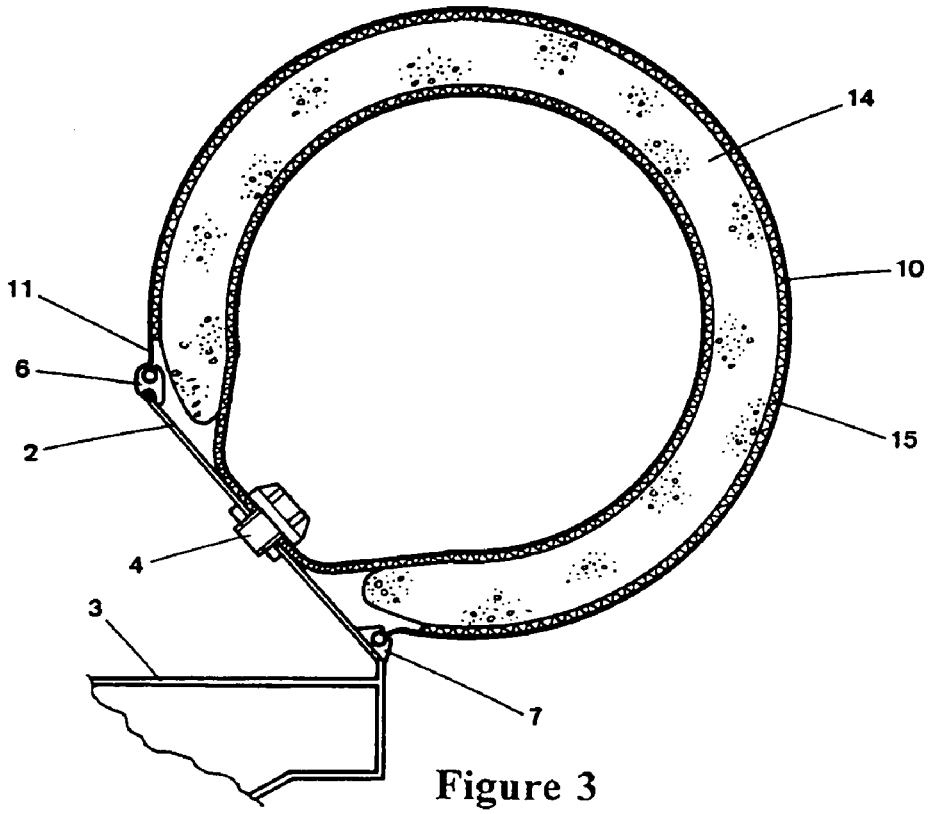
FIG. 3 is a view similar to FIG. I but illustrating yet another form of the fender system which utilises additional protection material.

Another form of outer covering is illustrated in FIG. 2. In this embodiment a layer 14 of foam is sandwiched between the bladder 1 and the outer covering 10. In a still further modification illustrated in FIG. 3, in addition to the layer 14 of foam, a strengthening layer 14' is inserted between the layer 14 of foam and the inner surface of the outer covering 10. The strengthening layer 14' can be composed of a variety of materials such as for instance that known under the trade name Kevlar. The type of material from which the outer covering 10 and the strengthening layer or layers when employed are formed will depend upon the type of usage the fender system will encounter. For instance, if the water craft is to be used in a combat zone or where there may be gunfire, then either the outer layer 10 and/or the strengthening layer 14' can be composed of a bullet proof material.

Figure 9:
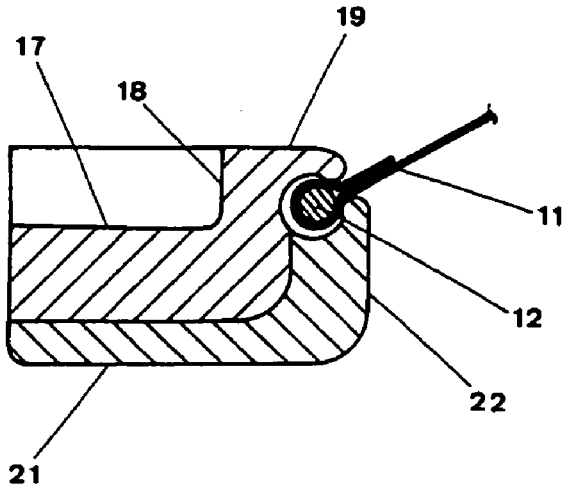
FIG. 9 is a side view in section of the assembled bolt rope locking device and of a bolt rope captured by the device.
Figure 4:
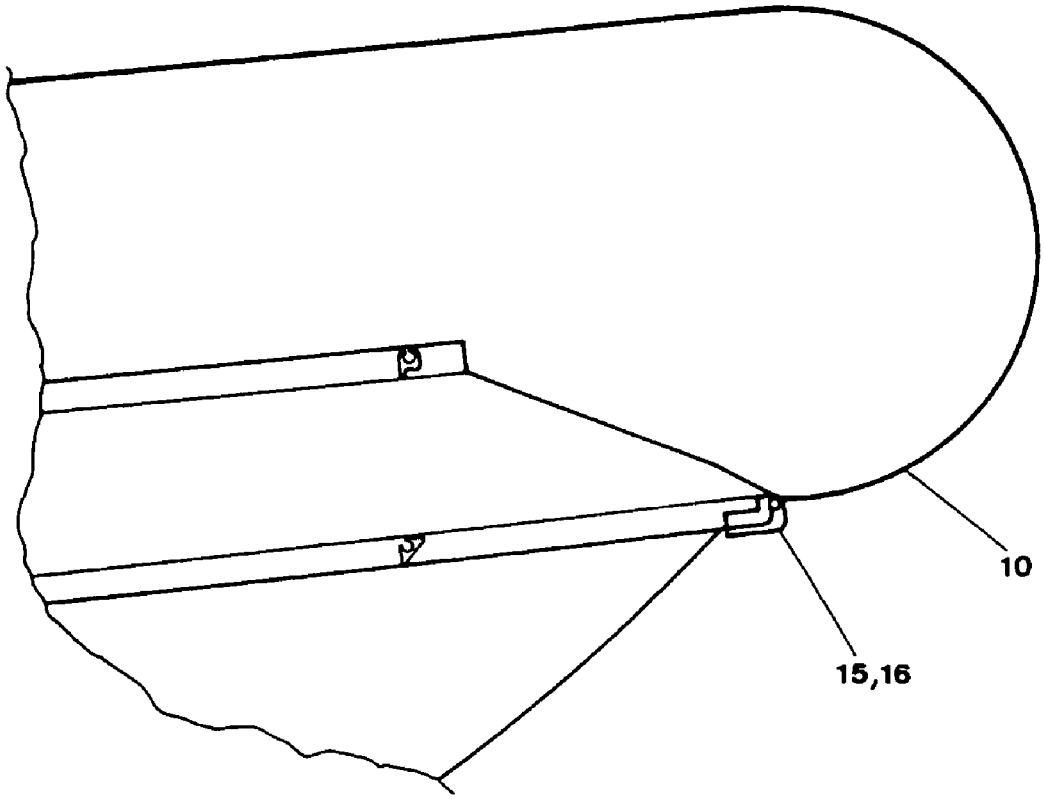
FIG. 4 is a diagrammatic illustration of the bow of a water craft together with the forward portion of the fender system.
Figure 5:
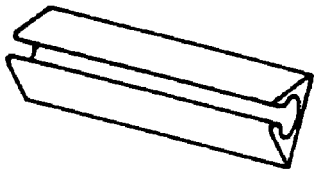
FIG. 5 is an illustration of part of one form of a bolt rope holding device.
Figure 6:
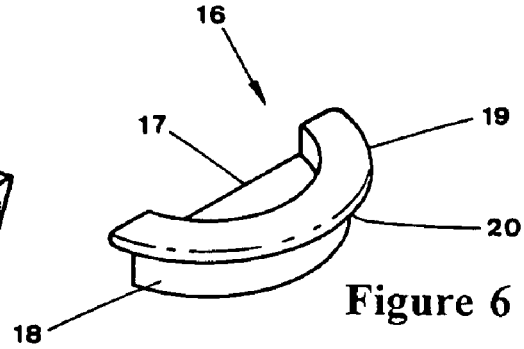
FIG. 6 is an illustration of a first part of a bolt rope locking device which is utilised for retaining the fender system to the bow of the water craft.
Figure 7:
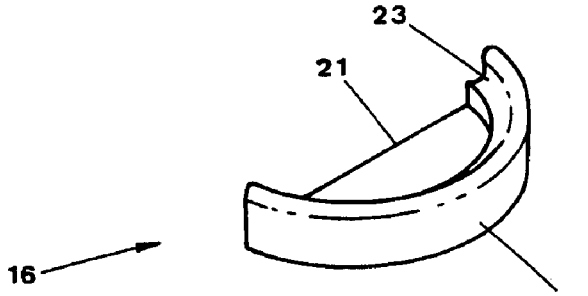
FIG. 7 is an illustration of the second part of the bolt rope locking device depicted in FIG. 6.
Figure 8:
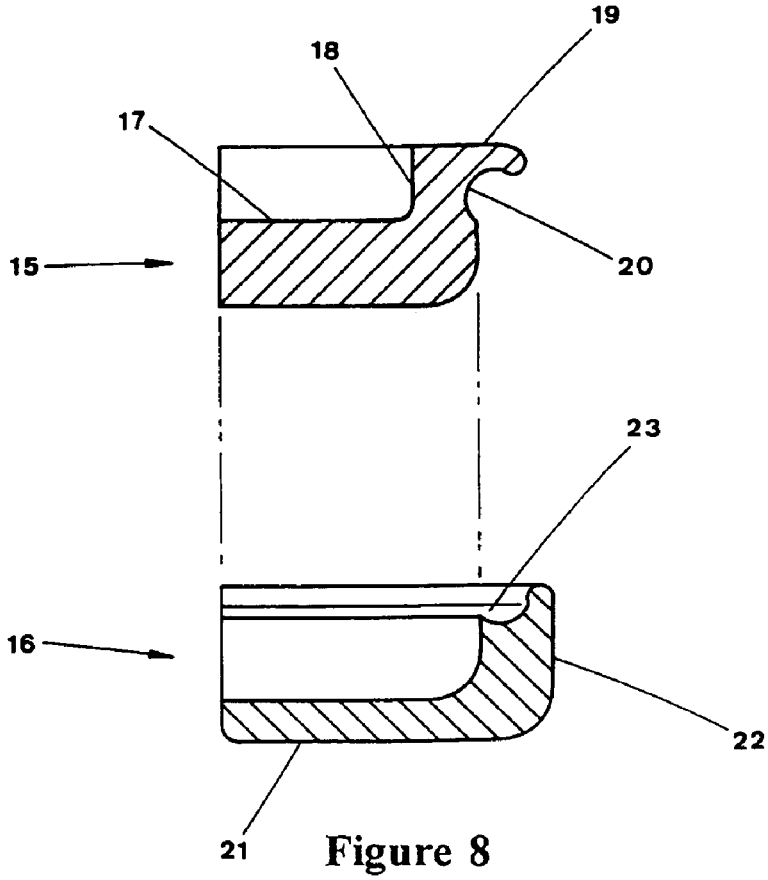
FIG. 8 is a sectional part view of the two parts of the bolt rope locking device in an exploded form.

A diagrammatic illustration of a typical bow of a water craft to which the fender has been applied is illustrated in FIG. 4. The bolt rope locking device which is preferably formed from an aluminium casting is more fully illustrated in FIGS. 6, 7, 8 and 9. The device is formed of two parts, the first or upper part 15 is illustrated in FIG. 6 and the second or lower part 16 is illustrated in FIG. 7. The upper part 15 is preferably a semi circular casting and has a floor 17 with an annular wall 18 extending upwardly from the semi-circular perimeter of the floor. The wall 18 terminates in a flange 19 which lies essentially parallel to the floor 17. As illustrated particularly in FIG. 8, the upper portion of the wall and the flange is formed with a goose neck 20. The lower part 16 also has a floor 21 and an annular flange 22, the upper surface of which terminates in a profile 23 which is complementary in shape to the goose neck 20. As illustrated in FIG. 9 the parts 15 and 16 are so constructed that the upper part 15 can engage within the lower part 16 to form a bolt rope anchor to grip the folded over ends 11 and rope 12 to capture the ends of the covering within the groove so formed. The parts 15 and 16 can include suitable holes (not shown in the drawings) so the two parts can be clamped together, although various means as will be apparent can be utilised to secure or clamp the two parts together.

To utilise the fender system, the bolt rope locking device is disassembled and the bladder is partly inflated or partly deflated if inflated. The ends of the bolt rope with the folded over ends of the outer covering are inserted into the exposed grooves of the bolt rope holders and the ends are pulled around the perimeter of the water craft until the ends meet with the bolt rope locking device. The ends of the bolt ropes are then engaged in the grooves of the bolt rope locking device and the two parts 15 and 16 are clamped together to capture the bolt rope within the locking device. The bladder can then be suitably inflated. To remove the fender system from the water craft, or to change the outer covering, the bladder is partly deflated, the two parts of the bolt rope locking device are separated and the outer covering is removed by sliding the bolt rope out of the grooves in the bolt rope holders.

It will be understood that the particular advantage of the form of bolt rope locking device as illustrated and described is that because it is positioned at the bow of the water craft, and because it is a solid casting, it is able to withstand knocks and blows which typically occur during usage of the water craft. In addition it will form protection against the bolt rope being damaged during such usage. Because the locking device is at the bow of the water craft it is readily accessible and by simply separating the upper part 15 from the lower part 16, the outer covering can be rapidly and easily removed or attached to the water craft. This makes the fender system of particular advantage when the occasion arises whereby the composition of the fender requires to be altered, such as by adding or removing the outer or inner layers of the bag.

Having read the foregoing description, it will be apparent that modifications and changes can be made to the specific items described and yet still come within the general concept of the invention. All such modifications and changes are intended to be included in the scope of this specification.

The invention has been described with particular emphasis on the preferred embodiments, but variations and modifications within the spirit and scope of the invention may occur to those skilled in the art to which the invention pertains.

The invention claimed is:

1. A method of securing a fender system to a water craft including the steps of:

securing longitudinally extending at least two rope holders to the hull of the water craft, said rope holders extending substantially the length of the hull being attachable to and being spacable apart vertically from each other, said rope holders each having an outwardly facing longitudinal channel extending the length of each rope holder and a throat which provides a continuous entrance to the longitudinal channel, the throat having a width that is less in dimension than the cross sectional dimension of the channel;

providing a bladder and an outer covering for the bladder, said outer covering having opposed longitudinal edges, the first longitudinal edge being folded over to house a bolt rope and the second longitudinal edge being folded over to form a continuous internal channel;

attaching the outer covering to the hull by sliding the first longitudinal edge of the outer covering into the channel of the first rope holder;

locating the bladder on the outer covering; and inserting the second folded over longitudinal edge of the outer covering into the second rope holder and sliding a rod through the channel formed by the folded over portion of the outer covering to retain the folded-over portion within the second rope holder.

2. The method of securing a fender system to a water craft as claimed in claim 1, further including the step of attaching the bolt rope to a rope locking device located at the forward end of the water craft, said rope locking device comprising two separable parts which when combined form a groove into which a rope can be secured, one of said separable parts attached to the craft and said second of said separable parts attached to the first separable part.

3. A water craft fender system for a water craft having a hull comprising an inflatable bladder, an outer covering for protecting the inflatable bladder, the outer covering adapted to be removably secured to the hull, at least two bolt rope holders secured to the water craft in spaced apart relation and extending substantially around the hull to provide upper and lower rope holders, each rope holder having an outwardly facing channel, the outer covering having two longitudinally opposed edges which are respectively captured within the channels of the upper and lower bolt rope holders by a bolt rope inserted within a fold formed in each edge of the outer covering, wherein the system further comprises:

a bolt rope locking device adapted to be located adjacent the bow of the water craft, said locking device comprising first and second separable parts forming a groove to receive and retain the folded edges of the outer covering and the bolt rope for securing the outer covering and the bolt rope to the hull of the water craft, wherein said first separable part of the bolt rope locking device comprises a member having a semi-circular shaped floor with an annular wall extending upwardly from the semi-circular perimeter of the floor and terminating in a flange extending outwardly from the wall, the upper portion of the annular wall and the flange forming a goose neck and wherein the second separable part comprises a member having a semi-circular shaped floor with an annular flange extending from the semi-circular portion of the floor and the annular flange having a profile complementary in shape to the goose neck of the first separable part, said first and second separable parts being engaged together, and the goose neck and the profile forming a groove suitable for receiving the folded over edges of the outer covering and the bolt rope, the folded over edges of the outer covering and the bolt rope being secured within the bolt rope locking device.

4. A system according to claim 3, wherein the first separable part of the bolt rope locking device is securable to the forward end of the water craft and the second separable part is adapted to be clamped to the secured first separable part after the folded edges of the outer covering and the bolt rope have been located between the goose neck of the first separable part and the profile of the second separable part.

5. A system according to claim 3, wherein the channels extend longitudinally along the length of the respective bolt rope holders and each bolt rope holder further comprises a longitudinal throat that forms an entrance to a respective channel.

6. A system according to claim 3, wherein an intermediate layer is sandwiched between the bladder and the outer covering.

7. A system according to claim 6, wherein the intermediate layer is foam.

8. A system according to claim 6, wherein the intermediate layer is a strengthening layer.

9. A method of securing a fender system to the hull of a water craft, the fender system comprising an inflatable bladder, an outer covering to protect the inflatable bladder and adapted to be removably secured to the hull, a bolt rope, and at least two bolt rope holders and secured to the hull in spaced apart relation and extending substantially around the hull to provide upper and lower rope holders, each rope holder having an outwardly facing channel, the outer covering having first and second longitudinally opposed edges, the method comprising the steps of:

folding the respective first and second longitudinally opposed edges of the outer covering over the bolt rope;

sliding the respective first and second folded over edges of the outer covering with the bolt rope into the respective channels of the bolt rope holders and along the length of the rope holders;

providing a bolt rope locking device adapted to be located adjacent the bow of the water craft and including two separable parts which, when assembled form a groove;

locating the respective first and second folded over edges of the outer covering with the bolt rope in the groove; and clamping the first and second separable parts together to secure the outer covering and bolt rope.

10. A method of securing a fender system to the hull of a water craft as claimed in claim 9 further comprising the steps of:

partly inflating the bladder if empty, or partly deflating the bladder if full, prior to sliding the folded edges of the outer covering with the bolt rope into the respective rope holders; and suitably inflating the bladder after clamping the first and second separable parts together.

* * * * *